US007723282B2

(12) United States Patent
Fleckenstein et al.

(10) Patent No.: US 7,723,282 B2
(45) Date of Patent: May 25, 2010

(54) LIQUID DETERGENT COMPOSITION

(75) Inventors: Melissa Fleckenstein, Clark, NJ (US); Kevin Kinscherf, Freehold, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 12/354,809

(22) Filed: Jan. 16, 2009

(65) Prior Publication Data

US 2009/0124527 A1 May 14, 2009

Related U.S. Application Data

(63) Continuation of application No. 11/558,701, filed on Nov. 10, 2006, now abandoned.

(51) Int. Cl.
*C11D 17/00* (2006.01)

(52) U.S. Cl. ..... 510/218; 510/424; 510/426; 510/428; 510/499

(58) Field of Classification Search ..... None
See application file for complete search history.

(56) References Cited

U.S. PATENT DOCUMENTS

| | | | |
|---|---|---|---|
| 4,457,856 | A | 7/1984 | Mitchell et al. |
| 5,425,806 | A | 6/1995 | Doolan |
| 5,534,265 | A | 7/1996 | Fowler et al. |
| 5,681,801 | A | 10/1997 | Zocchi |
| 5,750,489 | A | 5/1998 | Garcia |
| 5,866,529 | A | 2/1999 | Erilli et al. |
| 5,977,053 | A | 11/1999 | Groth |
| 6,033,680 | A | 3/2000 | Dixon et al. |
| 6,051,541 | A | 4/2000 | Neuser et al. |
| 6,165,510 | A | 12/2000 | Baines et al. |
| 6,268,330 | B1 | 7/2001 | Leonard et al. |
| 6,294,179 | B1 | 9/2001 | Lee et al. |
| 6,294,509 | B1 | 9/2001 | Meiwa et al. |
| 6,339,058 | B1 | 1/2002 | Toussaint et al. |
| 6,362,156 | B1 | 3/2002 | Hsu et al. |
| 6,369,018 | B1 | 4/2002 | Hsu et al. |
| 6,380,150 | B1 | 4/2002 | Toussaint et al. |
| 6,533,873 | B1 | 3/2003 | Margosiak et al. |
| 6,635,702 | B1 | 10/2003 | Schmucker-Castner et al. |
| 6,638,519 | B1 | 10/2003 | Lorant |
| 6,682,723 | B2 | 1/2004 | Parry |
| 6,767,878 | B1 | 7/2004 | Paye et al. |
| 6,770,612 | B1 | 8/2004 | Hatchman |
| 6,846,785 | B2 | 1/2005 | Patel |
| 6,849,588 | B2 | 2/2005 | Elsik |
| 6,927,201 | B2 | 8/2005 | Hsu et al. |
| 6,972,278 | B2 | 12/2005 | Hsu et al. |
| 7,022,657 | B2 | 4/2006 | Hines et al. |
| D529,398 | S | 10/2006 | Van Dingenen |
| 7,186,675 | B2 | 3/2007 | Meine |
| 2001/0056049 | A1 | 12/2001 | Aronson |
| 2002/0039561 | A1 | 4/2002 | Doughty |
| 2003/0044442 | A1 | 3/2003 | Stanier et al. |
| 2003/0171230 | A1 | 9/2003 | Shana et al. |
| 2004/0018950 | A1 | 1/2004 | Foley et al. |
| 2004/0186037 | A1 | 9/2004 | Cheung et al. |
| 2004/0223929 | A1 | 11/2004 | Clapp et al. |
| 2004/0223993 | A1 | 11/2004 | Clapp et al. |
| 2004/0234565 | A1 | 11/2004 | Stella et al. |
| 2004/0235690 | A1 | 11/2004 | Oldenhove |
| 2005/0020467 | A1 | 1/2005 | Kinscherf |
| 2005/0020471 | A1 | 1/2005 | Cheung et al. |
| 2005/0043200 | A1 | 2/2005 | Barry et al. |
| 2005/0079983 | A1 | 4/2005 | Paye |
| 2005/0100570 | A1 | 5/2005 | Wei et al. |
| 2005/0106112 | A1 | 5/2005 | Boyd et al. |
| 2005/0158268 | A1 | 7/2005 | Schmucker-Castner |
| 2005/0170982 | A1 | 8/2005 | Boone et al. |
| 2005/0176613 | A1 | 8/2005 | Wai Cheung et al. |
| 2005/0203213 | A1 | 9/2005 | Pommiers et al. |
| 2005/0227880 | A1 | 10/2005 | Shiloach |
| 2005/0245419 | A1 | 11/2005 | Guzmann et al. |
| 2005/0272622 | A1 | 12/2005 | Hariharan |
| 2006/0019861 | A1 | 1/2006 | Potechin et al. |
| 2006/0019862 | A1 | 1/2006 | Allen et al. |
| 2006/0083761 | A1 | 4/2006 | Yoshimi et al. |
| 2006/0194709 | A1 | 8/2006 | Boone et al. |
| 2007/0009463 | A1 | 1/2007 | Niebauer et al. |
| 2007/0010415 | A1 | 1/2007 | Kinscherf |
| 2007/0167338 | A1 | 7/2007 | McHugh et al. |
| 2008/0070823 | A1 | 3/2008 | Gorlin |
| 2008/0242581 | A1 | 10/2008 | Murphy |
| 2009/0105113 | A1 | 4/2009 | Tuzi |
| 2009/0163401 | A1 | 6/2009 | Gorlin |

FOREIGN PATENT DOCUMENTS

| | | |
|---|---|---|
| CA | 2 306 376 | 10/2000 |

(Continued)

OTHER PUBLICATIONS

Svelto Gel Microgranuli Strawberry Product Information retrieved from www.Unilever.com.

Analysis of Cif Gel product sold in Europe.

Analysis of Svelto Gel product sold in Europe.

*Primary Examiner*—Necholus Ogden, Jr.
(74) *Attorney, Agent, or Firm*—Michael F. Morgan

(57) ABSTRACT

A liquid detergent composition comprising surfactants, a suspending agent, beads, and water.

9 Claims, No Drawings

FOREIGN PATENT DOCUMENTS

| | | | |
|---|---|---|---|
| EP | 887071 | A1 | 9/1983 |
| EP | 0 452 106 | | 10/1991 |
| EP | 520551 | A2 | 12/1992 |
| EP | 1 090 631 | | 4/2001 |
| WO | 9405757 | | 3/1994 |
| WO | 9726315 | | 7/1997 |
| WO | 9929827 | A1 | 6/1999 |
| WO | 9960996 | | 12/1999 |
| WO | 0238720 | | 5/2002 |
| WO | 03099986 | | 12/2003 |
| WO | 03099986 | A1 | 12/2003 |
| WO | 2006021255 | | 5/2006 |
| WO | 2007111888 | A1 | 10/2007 |

LIQUID DETERGENT COMPOSITION

CROSS REFERENCE TO RELATED APPLICATIONS

This application is a continuation of U.S. application Ser. No. 11/558,701, filed Nov. 10, 2006, which is a continuation of PCT/US2006/015108, filed on 21 Apr. 2006, which claims the benefit of priority to U.S. Provisional Patent Application No. 60/673,685, filed on 21 Apr. 2005, both of which are incorporated herein by reference.

BACKGROUND OF THE INVENTION

Structured liquids are known in the art for suspending beads or particles in cleaning liquid compositions. The means of providing structure to the liquid includes using particular surfactants that thicken the liquid, or by the addition of thickening agents such as polymers and gums which thicken the liquid so as to be able to suspend particles or beads therein for long periods of time.

However, the suspension of beads in a cleaning liquid composition by the aforementioned use of surfactants, electrolytes, thickening agents, polymers and gums has some characteristics that consumers may consider unacceptable for certain products. Conventional structured liquids are often opaque or turbid thereby obscuring the suspended beads from the consumer, which are shown to best advantage in a transparent or clear liquid.

Further, the by-product of thickening a liquid to provide structure for suspended beads causes a significant increase in liquid viscosity and a corresponding decrease in liquid pourability, a property which consumers generally do not associate with certain products, such as a liquid detergent product.

SUMMARY OF THE INVENTION

The invention relates to a liquid detergent composition comprising surfactants, at least one suspending agent, visible beads that are suspended in the composition, and water wherein the surfactants comprise:

a) at least one ammonium or metal salt of a $C_8$-$C_{18}$ linear alkyl benzene sulfonate surfactant.

b) at least one ammonium or metal salt of an ethoxylated $C_8$-$C_{18}$ alkyl ether sulfate surfactant having 1 to 30 moles of ethylene oxide; and c) at least one amine oxide surfactant, wherein at least one of:

i) the at least one suspending agent comprises a gum, ii) the liquid detergent composition has a viscosity of less than 3.000 mPas at 25° C. and/or iii) the liquid detergent composition does not include an alkyl polysaccharide surfactant.

DETAILED DESCRIPTION OF THE INVENTION

As used throughout, ranges are used as a shorthand for describing each and every value that is within the range. Any value within the range can be selected as the terminus of the range. When used, the phrase "at least one of" refers to the selection of any one member individually or any combination of the members. The conjunction "and" or "or" can be used in the list of members, but the "at least one of" phrase is the controlling language. For example, at least one of A, B, and C is shorthand for A alone, B alone, C alone, A and B, B and C, A and C, or A and B and C.

As used throughout, metal cations that can be used include, but are not limited to, alkali metal ions and alkaline earth ions. In some embodiments, the metal cation ion can be lithium, sodium, potassium, magnesium, or calcium.

The at least one ammonium or metal salt of a $C_8$-$C_{18}$ linear alkyl benzene sulfonate surfactant include the well known higher alkyl benzene sulfonates containing from 8 to 18 carbon atoms, more preferably 10 to 16 carbon atoms in the higher alkyl group in a straight or branched chain. In one embodiment, the linear alkyl benzene sulfonate has a high content of 3-(or higher) phenyl isomers and a correspondingly low content (well below 50%) of 2-(or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Examples of materials that can be used are set forth in U.S. Pat. No. 3,320,174.

The at least one ammonium or metal salt of a $C_8$-$C_{18}$ linear alkyl benzene sulfonate surfactant can be present in the composition at any desired amount. In one embodiment, the amount is 1-30% by weight of the composition on an active basis. In another embodiment, the amount is 1-15% by weight. In another embodiment, the amount is 10-15% by weight.

In one embodiment the at least one ammonium or metal salt of a $C_8$-$C_{18}$ linear alkyl benzene sulfonate surfactant is a mixture of the magnesium and sodium salts. In one embodiment, the ratio of the magnesium salt to the sodium salt is 2-4:1.

The $C_8$-$C_{18}$ ethoxylated alkyl sulfate surfactants can have the structure $$R^{10}\text{—}(OCHCH_2)_nOSO_3^-M^+$$

wherein n is about 1 to about 22 more preferably 1 to 3 and $R^{10}$ is an alkyl group having about 8 to about 18 carbon atoms, more preferably 12 to 15 and natural cuts, for example, $C_{12-14}$:$C_{12-15}$ and M is an ammonium cation, alkali metal or an alkaline earth metal cation, most preferably magnesium sodium or ammonium. The ethoxylated alkyl ether sulfate is generally present in the composition at a concentration of about 0 to about 30 wt. %, more preferably about 0.5 wt. % to 15 wt. %.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol. In one embodiment, the amount of the ethoxylated alkyl ether sulfate surfactant is about 1 to about 8% by weight of the composition.

In one embodiment, the at least one ammonium or metal salt of an ethoxylated $C_8$-$C_{18}$ alkyl ether sulfate surfactant having 1 to 30 moles of ethylene oxide comprises a $C_{12-15}$ alcohol ethoxylate 1.3:1 ammonium sulfate surfactant.

Amine oxide semi-polar nonionic surfactants can comprise compounds and mixtures of compounds having the formula:

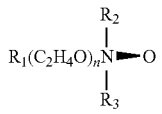

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

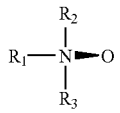

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 which is hereby incorporated herein by reference.

In one embodiment, the at least one amine oxide surfactant comprises a mixture of lauramidopropyldimethylamine oxide and myristamidopropylamine oxide.

Additional surfactants, such as anionic surfactants, non ionic surfactants, amphoteric surfactants, and zwitterionic surfactants can be included in the liquid detergent composition. Examples of the other anionic surfactants, nonionic surfactants, amphoteric surfactants, zwitterionic surfactants, or surfactant combinations that can be used or modified to be used in the present invention can be found in U.S. Patent Application Publication No. 2005/0049170; U.S. Patent Application Publication No. 2005/0049161; U.S. Patent Application Publication No. 2004/0101504; U.S. Patent Application Publication No. 2003/0144218; U.S. Pat. No. 6,884,764; U.S. Pat. No. 6,605,579, U.S. Pat. No. 6,593,284; U.S. Pat. No. 6,583,178; U.S. Pat. No. 6,586,014; U.S. Pat. No. 6,815,406; U.S. Pat. No. 6,627,589; U.S. Pat. No. 6,541,436; U.S. Pat. No. 6,475,967; U.S. Pat. No. 6,441,037; U.S. Pat. No. 6,444,636; U.S. Pat. No. 6,821,939; U.S. Pat. No. 6,268,330; U.S. Pat. No. 6,262,003; U.S. Pat. No. 6,255,269; or U.S. Pat. No. 6,251,844, all of which are incorporated herein by reference. In one embodiment, the composition does not include an alkyl polysaccharide surfactant.

Suspending agents are any material that increases the ability of the liquid detergent composition to suspend material. Examples of suspending agents include, but are not limited to gum suspending agents and synthetic polymer suspending agents. Examples of gum suspending agents include, but are not limited to gellan gum, pectine, alginate, arabinogalactan, carageenan, xanthum gum, guar gum, rhamsan gum, furcellaran gum, and combinations thereof. A preferred suspending agent is gellan gum, and it can be obtained from CP Kelco under the tradename KELCOGEL. In one embodiment, the gellan gum is KELCOGEL AFT.

The synthetic polymer suspending agent is preferably a polyacrylate. One acrylate aqueous solution used to allow a stable suspension of the solid particles is manufactured by Noveon as Carbopol Aqua 30. The Carbopol resins, also known as "Carbomer," are hydrophilic high molecular weight, crosslinked acrylic acid polymers having an average equivalent weight of 76, and the general structure illustrated by the following formula has a molecular weight of about 1,250,000; Carbopol 940 a molecular weight of approximately 4,000,000 and Carbopol 934 a molecular weight of approximately 3,000,000. The Carbopol resins are crosslinked with polyalkenyl polyether, e.g. about 1% of a polyalkyl ether of sucrose having an average of about 5.8 alkyl groups for each molecule of sucrose.

The suspending agent can be included in the composition in any amount to give a desired amount of suspension. In one embodiment, the amount of suspending agent is 0.01-10% by weight of the composition.

The beads can be made from a variety of materials as long as their composition and size permit the suspension of the beads in the liquid detergent composition. Examples of beads include, but are not limited to, gelatin, celluloses, agar, gum arabic, alginates, waxes, polyethylenes, polyvinyl alcohol, poly(meth)acrylates, polystyrenes, polyurethanes, polyamides, polyepoxides, vinyl acetates, and polyvinyl pyrrolidones. Preferably, the beads are made from at least one of agar, alginate, gum arabic, and/or gelatin. These types of beads can be obtained from Lipo Technologies. Inc. under the tradename LIPOSPHERES or International Specialty Products under the tradename CAPTIVATES. These types of beads are porous and allow the bulk liquid that they are placed in to diffuse into the bead. This helps the beads become density matched to the composition to aid in suspension of the bead. Alternatively, materials can be encapsulated into beads to change their density to match the density of the bulk liquid.

The amount of beads in the liquid detergent composition can be any desired amount. In one embodiment, the amount of beads is 0.01% to 30% by weight of the composition.

Beads can be of any size that is viewable by a person. By viewable it is meant that the beads can be seen by a person with an unaided eye at 20/20 or corrected to 20/20 with glasses or contact lenses. In one embodiment, the particle size ranges from 100 to 2500 microns in diameter. In another embodiment, the particle size ranges from 250 to 2250 microns. In another embodiment, the particle size ranges from 500 to 1500 microns.

The liquid detergent composition can keep the beads suspended for at least 2 weeks at room temperature. By suspended it is meant that at least 90%, or at least 95%, or at least 97%, or at least 99% of the beads remain suspended in the composition without settling out. In other embodiments, the beads can be suspended for at least two months, at least six months, or at least one year at room temperature. In other embodiments, the liquid detergent composition can keep the beads suspended for at least 18 weeks at 40.5° C. (105° F.). In another embodiment, the liquid detergent composition can keep the material suspended for at least 2 weeks at −10° C. In another embodiment, the liquid detergent composition can keep the beads suspended for at least 3 weeks at 4.5° C. While factors such as the amount of surfactant, the size of the beads, and the amount of suspending agent can affect stability, amounts for each of these factors can be selected so that the above stability tests are met.

The present liquid detergent compositions are made by simple mixing methods from readily available components which, on storage, do not adversely affect the entire composition. Mixing can be done by any mixer that forms the composition. Examples of mixers include, but are not limited to, static mixers and in-line mixers. Solubilizing agents such as a $C_1$-$C_3$ alkyl substituted benzene sulfonate such as sodium cumene or sodium xylene sulfonate and mixtures thereof are used at a concentration of 0.5 wt. % to 10 wt. % to assist in solubilizing the surfactants.

The viscosity of the composition can be adjusted to give any desired viscosity. In one embodiment, the viscosity is less than 5,000 mPas. In another embodiment, the viscosity is less than 1.500 mPas. In another embodiment, the viscosity is 500-1500 mPas. Viscosity is measured using a Brookfield Viscometer using a number 21 spindle rotating at 20 rpm at 25° C. The liquid detergent compositions of the instant invention are pourable and have an apparent yield value of at least 5 Pa.

The pH of the composition can be formulated to be any pH. In one embodiment, the pH is 3-10. In another embodiment, the pH is 6-8 or 6.5-7.5.

In addition, the liquid detergent composition may also employ normal and conventional adjuvants. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pH modifiers; etc. The proportion of such adjuvant materials, in total will normally not exceed 15% by weight of the detergent composition and the percentages of most of such individual components will be a maximum of 5% by weight and preferably less than 2% by weight. Sodium bisulfite can be used as a color stabilizer at a concentration of 0.01 to 0.2 wt. %. Other additives can be found in the patents and patent application publications referenced above.

In one embodiment, the liquid detergent composition comprises 12-15% by weight of $C_{12-15}$ alcohol EO1.3:1 ammonium sulfate, 9-11% by weight magnesium dodecyl benzene sulfonate, 3-5% by weight sodium dodecyl benzene sulfonate, 4-6% by weight lauramidopropyldimethylamine oxide, and 1-2% by weight of myristamidopropylamine oxide, and 0.1-0.2% by weight gellan gum.

The liquid detergent compositions of the present invention can be formulated into dishwashing detergents, laundry detergents, or hand soaps.

The following examples illustrate liquid cleaning compositions of the described invention. Unless otherwise specified, all percentages are by weight. The exemplified compositions are illustrative only and do no limit the scope of the invention. Unless otherwise specified, the proportions in the examples and elsewhere in the specification are by active weight. The active weight of a material is the weight of the material itself excluding water or other materials that may be present in the supplied form of the material.

In the following examples, Composition A is a liquid detergent composition in accordance with the invention.

Composition B is a liquid detergent composition in accordance with U.S. Pat. No. 6,339,058 (Toussaint et al), which is incorporated herein by reference, using polyacrylate as a thickener.

Composition C is a liquid crystal composition in accordance with U.S. Published Application 2005/0020467, which is incorporated herein by reference.

TABLE 1

| Product Composition, wt/wt %: | A | B | C |
|---|---|---|---|
| Water | QS | QS | QS |
| C12-15 Alcohol EO 1.3:1 Ammonium Sulfate | 12.2 | 12.2 | 8.05 |
| Mg Dodecyl Benzene Sulfonate | 9.3 | 9.3 | 6.31 |
| Lauramidopropyldimethylamine oxide | 4.3 | 4.3 | 3.50 |
| Na Dodecyl Benzene Sulfonate | 3.9 | 3.9 | 2.10 |
| APG | — | — | 6.65 |
| Neodol 1-3 | — | — | 15.00 |
| Ethanol | 3.5 | 3.5 | — |

TABLE 1-continued

| Product Composition, wt/wt %: | A | B | C |
|---|---|---|---|
| Sodium Xylene Sulfonate (40%) | 2.0 | 2.0 | 1.25 |
| Myristamidopropylamine oxide | 1.4 | 1.4 | — |
| Fragrance | 0.5 | 0.5 | — |
| Gellan Gum (Kelcogel AFT) | 0.125 | — | — |
| Carbopol Aqua 30 | — | 2.8 | — |
| Pentasodium Pentetate | 0.13 | 0.13 | — |
| Dissolve D-40 | | | 0.09 |
| DMDM Hydantoin | 0.12 | 0.12 | 0.11 |
| PPG-20 Methyl Glucose Ether | 0.06 | — | — |
| Liposhere Beads | 0.45 | 0.45 | 0.45 |
| Brookfield Viscosity, cP | 1000 | 25000 | — |
| Pourable | yes | no | yes |
| Turbidity, RTU (water = 1) | <2 | <2 | >10 |

The following is a prophetic example of another composition according to the invention.

TABLE 2

| Product Composition, wt/wt %: | |
|---|---|
| C12-15 Alcohol EO 1.3:1 Ammonium Sulfate | 13.6 |
| Mg Dodecyl Benzene Sulfonate | 9.9 |
| Na Dodecyl Benzene Sulfonate | 4.4 |
| Lauramidopropyldimethylamine oxide | 4.8 |
| Myristamidopropylamine oxide | 1.6 |
| Ethanol | 4.9 |
| Sodium Xylene Sulfonate | 1.95 |
| Gellan Gum (Kelcogel AFT) | 0.124 |
| Captivates Beads | 0.55 |
| Water and minors | balance |

What is claimed is:

1. A dishwashing liquid detergent composition comprising surfactants, at least one suspending agent, beads having a particle size of 100 to 2500 microns suspended in the composition, and water, wherein the surfactants consist of:

a) magnesium dodecyl benzene sulfonate surfactant, sodium dodecyl benzene sulfonate surfactant, at least one ammonium or metal salt of an ethoxylated C8-C18 alkyl ether sulfate surfactant having 1 to 20 moles of ethylene oxide, lauramidopropyldimethylamine oxide surfactant, and myristamidopropylamine oxide surfactant, wherein at least one of:

i) the at least one suspending agent consists of gellan gum, and/or ii) the liquid detergent composition has a viscosity of less than 3,000 mPas at 25° C.

2. The liquid detergent composition of claim 1, wherein a ratio of magnesium dodecyl benzene sulfonate surfactant to sodium dodecyl benzene sulfonate surfactant is 2-4:1.

3. The liquid detergent composition of claim 1, wherein the at least one ammonium or metal salt of an ethoxylated $C_8$-$C_{18}$ alkyl ether sulfate surfactant having 1 to 30 moles of ethylene oxide comprises a $C_{12-15}$ alcohol ethoxylate 1.3:1 ammonium sulfate surfactant.

4. The liquid detergent composition of claim 1, wherein the surfactants are present at least 20% by weight in the composition on an actives basis.

5. The liquid detergent composition of claim 1, wherein the surfactants are present at least 30% by weight in the composition on an actives basis.

6. The liquid detergent composition of claim 1, wherein the liquid detergent composition has a viscosity of less than 1,500 mPas at 25° C.

7. A dishwashing liquid detergent composition comprising surfactants, a suspending agent consisting of 0.1-0.2% by weight gellan gum, beads having a particle size of 100 to 2500 microns suspended in the composition, and water, wherein the surfactants consist of:

a) 9-11% by weight magnesium dodecyl benzene sulfonate, b) 3-5% by weight sodium dodecyl benzene sulfonate, c) 12-15% by weight of $C_{12-15}$ alcohol EO1.3:1 ammonium sulfate;

d) 4-6% by weight lauramidopropyldimethylamine oxide surfactant, and e) 1-2% by weight myristamidopropylamine oxide surfactant, wherein the liquid detergent composition has a viscosity of less than 3,000 mPas at 25° C.

8. The liquid detergent composition of claim 1, wherein a combined amount of the lauramidopropyldimethylamine oxide surfactant and the myristamidopropylamine oxide surfactant is present at 1 to 30% by weight of the composition on an active basis.

9. The liquid detergent composition of claim 1, wherein the composition has a viscosity of less than 5,000 mPas at 25° C.

* * * * *

UNITED STATES PATENT AND TRADEMARK OFFICE

CERTIFICATE OF CORRECTION

PATENT NO. : 7,723,282 B2
APPLICATION NO. : 12/354809
DATED : May 25, 2010
INVENTOR(S) : Melissa Fleckenstein et al.

It is certified that error appears in the above-identified patent and that said Letters Patent is hereby corrected as shown below:

In column 6, about line 42, change the number "20" to "30". As corrected, claim 1 is:

1. A dishwashing liquid detergent composition comprising surfactants, at least one suspending agent, beads having a particle size of 100 to 2500 microns suspended in the composition, and water, wherein the surfactants consist of:
a) magnesium dodecyl benzene sulfonate surfactant, sodium dodecyl benzene sulfonate surfactant, at least one ammonium or metal salt of an ethoxylated C8-C18 alkyl ether sulfate surfactant having 1 to 30 moles of ethylene oxide, lauramidopropyldimethylamine oxide surfactant, and myristamidopropylamine oxide surfactant, wherein at least one of:
i) the at least one suspending agent consists of gellan gum, and/or
ii) the liquid detergent composition has a viscosity of less than 3,000 mPas at 25°C.

Signed and Sealed this
Fourteenth Day of June, 2011

David J. Kappos

David J. Kappos
*Director of the United States Patent and Trademark Office*